US007337584B2

(12) United States Patent
Viens

(10) Patent No.: US 7,337,584 B2
(45) Date of Patent: Mar. 4, 2008

(54) INSULATED CEILING HATCH

(75) Inventor: Christopher P. Viens, Waterbury, VT (US)

(73) Assignee: C & C Enterprises, Inc., Waterbury Center, VT (US)

( * ) Notice: Subject to any disclaimer, the term of this patent is extended or adjusted under 35 U.S.C. 154(b) by 676 days.

(21) Appl. No.: 10/736,131

(22) Filed: Dec. 15, 2003

(65) Prior Publication Data

US 2004/0187404 A1 Sep. 30, 2004

Related U.S. Application Data

(60) Provisional application No. 60/456,511, filed on Mar. 24, 2003.

(51) Int. Cl.
*E02D 29/14* (2006.01)
*E06B 1/04* (2006.01)

(52) U.S. Cl. ..... 52/20; 52/204.1; 52/207; 52/19

(58) Field of Classification Search ..... 52/202, 52/203, 204.1, 204.2, 205, 207, 404.1, 407.1, 52/407.3, 407.4, 19, 20; 49/386, 399–402
See application file for complete search history.

(56) References Cited

U.S. PATENT DOCUMENTS

| | | | | |
|---|---|---|---|---|
| 4,151,894 | A | 5/1979 | Edwards | 182/77 |
| 4,281,743 | A | 8/1981 | Fuller | 182/46 |
| 4,299,059 | A | 11/1981 | Smith | 49/401 |
| 4,312,423 | A | 1/1982 | Helbig | 182/46 |
| 4,344,505 | A | 8/1982 | Waters et al. | 182/47 |
| 4,541,208 | A | 9/1985 | Vesperman et al. | 52/19 |
| 4,550,534 | A | 11/1985 | Mariano et al. | 52/19 |
| 4,563,845 | A | 1/1986 | Stipe | 52/202 |
| 4,591,022 | A | 5/1986 | Sciambi | 182/47 |
| 4,658,555 | A | 4/1987 | Steiner | 52/202 |
| 4,738,054 | A | 4/1988 | Muth et al. | 49/386 |
| 4,832,153 | A | 5/1989 | Daw et al. | 182/46 |
| 4,928,441 | A | 5/1990 | Daley | 52/19 |
| 4,944,126 | A | 7/1990 | King | 52/202 |
| 5,271,198 | A | 12/1993 | Freeman | 52/202 |
| 5,274,966 | A | 1/1994 | Daley | 52/23 |
| 5,481,833 | A | 1/1996 | Williams | 52/19 |
| 5,628,151 | A | 5/1997 | Monat | 52/19 |
| 5,867,946 | A | 2/1999 | Seagren | 52/19 |
| 5,950,368 | A * | 9/1999 | Bradford | 52/20 |
| 6,014,841 | A * | 1/2000 | McCoy et al. | 52/19 |

(Continued)

*Primary Examiner*—Jeanette Chapman
*Assistant Examiner*—Elizabeth A Plummer
(74) *Attorney, Agent, or Firm*—Michael J. Weins; Jeffrey E. Semprebon

(57) ABSTRACT

A ceiling hatch employs a frame having an upper edge and a lower edge and a passage bounded by a sidewall passing therebetween, the passage extending from the lower edge to the upper edge and having its minimum cross section at the lower edge. This frame is employed with an insulating block bounded by a top surface, a bottom surface and a side surface, and which is configured to be positionable substantially within the passage and substantially filling the same. A hinge attaches the frame to the insulating block, providing pivotable action between the insulating block and the frame about a pivot axis and allowing the insulating block to be swung out of the passage on an interference-free path such that the bottom surface of the insulating block is in a horizontal plane when the insulating block resides substantially within the passage.

20 Claims, 4 Drawing Sheets

U.S. PATENT DOCUMENTS

| | | | | |
|---|---|---|---|---|
| RE36,975 | E | 12/2000 | Williams | 52/19 |
| 6,223,490 | B1 | 5/2001 | Wessley et al. | 52/404.1 |
| 6,578,327 | B1 * | 6/2003 | Hackbarth et al. | 52/202 |
| 6,615,544 | B1 * | 9/2003 | Tlemcani et al. | 52/783.13 |
| 6,701,676 | B1 * | 3/2004 | Kompelien | 52/19 |
| 7,028,431 | B2 * | 4/2006 | Tlemcani et al. | 52/19 |
| 2002/0112409 | A1 | 8/2002 | Knowles | 52/19 |
| 2002/0190070 | A1 | 12/2002 | Panetta et al. | 220/592.2 |
| 2006/0258284 | A1 * | 11/2006 | Melesky | 454/349 |

* cited by examiner

INSULATED CEILING HATCH

This application claims priority of Provisional Application No. 60/456,511 filed Mar. 24, 2003.

FIELD OF THE INVENTION

The present invention relates to hatches for allowing access to an area located above a ceiling, and more particularly to a hatch which provides both ease of use and high resistance to heat loss.

BACKGROUND OF THE INVENTION

Ceilings that separate occupied areas of a building from an attic area residing above the ceiling serve to reduce heat loss and associated energy costs by providing a trapped region of air in the attic space that serves as an insulator. The reduction of heat loss can be increased by covering the ceiling with an insulating material. However, when a hatch is installed in the ceiling to provide access to the attic space, the hatch interrupts the ceiling and can allow increased air infiltration between the occupied areas and the attic, reducing the insulating properties of the ceiling. This reduction in insulation of the ceiling is exacerbated when additional insulating material is placed on the ceiling, as this additional material must be removed from the area overlying the hatch.

One approach to limiting air infiltration and providing insulation over the area occupied by the hatch, when the hatch opens downwardly, is to place a cap of insulating material over the hatch opening, as taught in U.S. Pat. Nos. 4,151,894; 4,281,743; 4,312,423; 4,344,505; 4,541,208; 4,550,534; 4,591,022; 4,658,555; 4,832,153; 4,928,441; 5,271,198; 5,274,966; 5,481,833; 5,628,151; 5,867,946; and Re. 369,975; and in published applications U.S. 20020190070 and U.S. 20020112409. These caps are bulky and may be difficult for a user to reinstall properly when exiting the attic space.

An alternative approach for downwardly-opening hatches is to provide insulation on a door of the hatch, and to configure the door to seal against a frame to prevent air infiltration. This approach is taught in U.S. Pat. Nos. 4,299,059; 4,563,845; and 4,738,054. While these hatches provide ease of use, the thickness of insulation that can be provided on the doors of these hatches is very limited, particularly when the door also serves as a support for fold-down stairs. Even when such stairs are not employed, the thickness of insulation is limited since the insulation extends into and partially obstructs the hatch opening when the door hangs open.

A further limitation to all these downwardly-opening hatches is that there is no structure for holding back surrounding insulating material when additional insulating material has been placed on the ceiling. This requires the thickness of the insulating material in the region surrounding the hatch opening to be reduced, reducing the overall effectiveness of the additional insulating material.

The problems of limited hatch insulation and reduced thickness of insulating material around the hatch opening have been partially overcome for upwardly-opening trap doors, as taught in U.S. Pat. No. 4,944,126. The '126 patent teaches the construction of a box or guard around the hatch opening to hold back loose insulating material, in combination with a harness for securing insulating material to the trap door, which is lifted out of the opening to provide access. While the thickness of the insulating material on the door is not limited as with downwardly opening hatches, the insulating material must be spaced from the box or guard sufficiently to allow the user to lift and replace the door without binding. Thus, the insulating material cannot reside in close proximity to the box or guard for a substantial portion of its height, creating gaps in the insulating material. Furthermore, even if binding of the insulating material attached to the door is avoided, the lift-out trap door may still be difficult for the user to reinstall to close the opening. Another lift-out trap door is taught in U.S. Pat. No. 6,223,490, which teaches a lift-out door configured to engage a sleeve to provide an improved seal against air infiltration. However, the thickness of insulation of the '490 door appears to be very limited, and reinstallation of the door may again be difficult.

Thus, there is a need for an insulated ceiling hatch which overcomes the deficiencies of the devices discussed above.

SUMMARY OF THE INVENTION

The present invention is a ceiling hatch which provides access to a space thereabove, such as an attic. The ceiling hatch has a frame which is bound by an upper edge and a lower edge and which has a passage extending between the upper edge and the lower edge. The passage is bounded by a sidewall which defines the passage periphery. The passage is further configured such that it has a minimum cross section at the lower edge of the passage. When the hatch is employed in a ceiling that is covered by insulation, the sidewall of the frame serves to hold back the insulation surrounding the passage and allows a uniform depth of insulation to be maintained above the ceiling.

An insulating block is provided, which is bounded by a top surface, a bottom surface, and a side surface. The side surface is configured such that the insulating block can be positioned within the passage and, when so located, substantially fills the passage. The bottom surface of the insulating block is preferably made of a material that is fire retardant, durable, and which can be readily painted to match the surrounding ceiling.

A hinge is operably attached to both the frame and the insulating block so as to provide a pivotal motion therebetween about a pivot axis that is spaced apart from the lower edge of the frame. Additionally, the position of the hinge and the configurations of the sidewall of the frame and the side surface of the insulating block are selected such that the insulating block can be pivoted into and out of the passage without interference between the sidewall and the insulating block.

Means to maintain the bottom surface of the insulating block in a horizontal plane when the ceiling hatch is installed in a ceiling and the insulating block resides substantially within the passage are provided. There are a variety of elements which can serve as means for maintaining the bottom surface of the insulating block in a horizontal plane. Some of these options include having the side surface of the block configured to engage the sidewall of the frame when the bottom surface of the block is horizontally positioned. Alternatively, a rim can be mounted to the lower edge of the frame and extend so as to provide a lip on which the bottom surface of the insulating block can rest. Another alternative is to provide a block cap which attaches to the top surface of the insulating block and extends beyond the side surface, the block cap being configured to engage the upper edge of the frame when the bottom surface of the block is in a horizontal position.

When the hatch is closed, the insulating block resides substantially within the passage, and the bottom surface is aligned with the lower edge of the frame. When the hatch is open, the insulating block has been pivoted to a position where it is removed from the passage, and a user can pass through the passage. By connecting the insulating block to the frame with a hinge, the insulating block is guided into the passage when the hatch is closed by the user, facilitating closure of the hatch.

The insulating block is preferably configured such that a substantial portion of the side surface of the insulating block resides in contact with or in close proximity to the sidewall of the frame when the hatch is closed. Providing, on the average, a small separation S between the insulating block and the frame serves to impede air flow therebetween. Preferably, the separation S is maintained less than about ⅛" over a substantial portion of the side surface and the sidewall. The separation S is more preferably maintained at about 1/16", but providing such close spacing between the side surface of the insulating block and the sidewall of the frame may make fabrication of the hatch more difficult.

To reduce leakage of air between the side surface of the insulating block and the sidewall of the frame when the hatch is closed, it is preferred to provide means for sealing the passage with respect to the insulating block. These means can be provided by having the sidewall of the passage and side surfaces of the insulating block configured to engage such that a seal is created therebetween. Alternatively, when a rim is employed which extends under the periphery of the passage so as to form a lip, the means for sealing can be provided by the engagement of the bottom surface of the insulating block with the lip. Alternatively, weatherstripping can be applied to the sidewall and/or to the insulating block to seal the passage. It is preferred that the weatherstripping be positioned such that the seal resides in close proximity to the upper edge of the frame. More than one of the above structures could be used in combination to provide the means for sealing. Providing means for sealing the passage makes the hatch beneficial even when employed in an uninsulated ceiling.

To simplify installation of the hatch, it is preferred to employ a frame that includes a rim attached to the lower edge. To simplify both the fabrication and the installation of such a rimmed hatch, it is further preferred for the profile of the frame to be such that a horizontal section is rectangular and one of the vertical projections has at least a lower section which is substantially trapezoidal, having one of its non-parallel sides being substantially vertical. The projection normal to the substantially trapezoidal projection is rectangular. Such a configuration allows the frame to be passed through an oversized rectangular cut-out in a ceiling and installed from below by attaching to the rafters. The gap between the frame and the cut out in the ceiling which results from having the cut-out sufficiently large to tilt the frame into position with the rim attached thereto is a function of the height of the frame. However, the rim can be configured to extend outward from and beyond the lower edge of the frame to form a flange that extends a distance sufficient to cover the cut-out through which the frame is passed. This allows the hatch to be mounted with no additional operations required to fill or cover gaps. Such an extending rim is advantageous even if the rim does not provide a lip for maintaining the bottom surface of the insulating block horizontal.

It is frequently preferred to provide a seal between the lower edge of the frame and the ceiling in which the hatch is mounted to further reduce air leakage. When an extending rim is employed, a seal can be readily provided between the protruding flange and the ceiling.

BRIEF DESCRIPTION OF THE DRAWINGS

FIG. 2 also shows a top surface of the insulating block that is foreshortened so as to provide an open region between the top surface and the sidewall of the frame at the upper edge of the frame. This provides a grippable region of the insulating block to allow the hatch to be readily opened in the event it is inadvertently closed while a person is in the attic.

FIG. 10 is a partially exploded isometric view of a ceiling hatch which forms another embodiment of the present invention. In this embodiment, a block cap is provided which is attached to the top surface of the insulating block and can be made integral with the insulating block. The cap is designed to engage the upper edge of the frame to provide a seal between the insulating block and the frame. The cap can also maintain the lower surface of the block in a horizontal position when the ceiling hatch is closed.

DETAILED DESCRIPTION OF THE PREFERRED EMBODIMENTS

Figure 1:
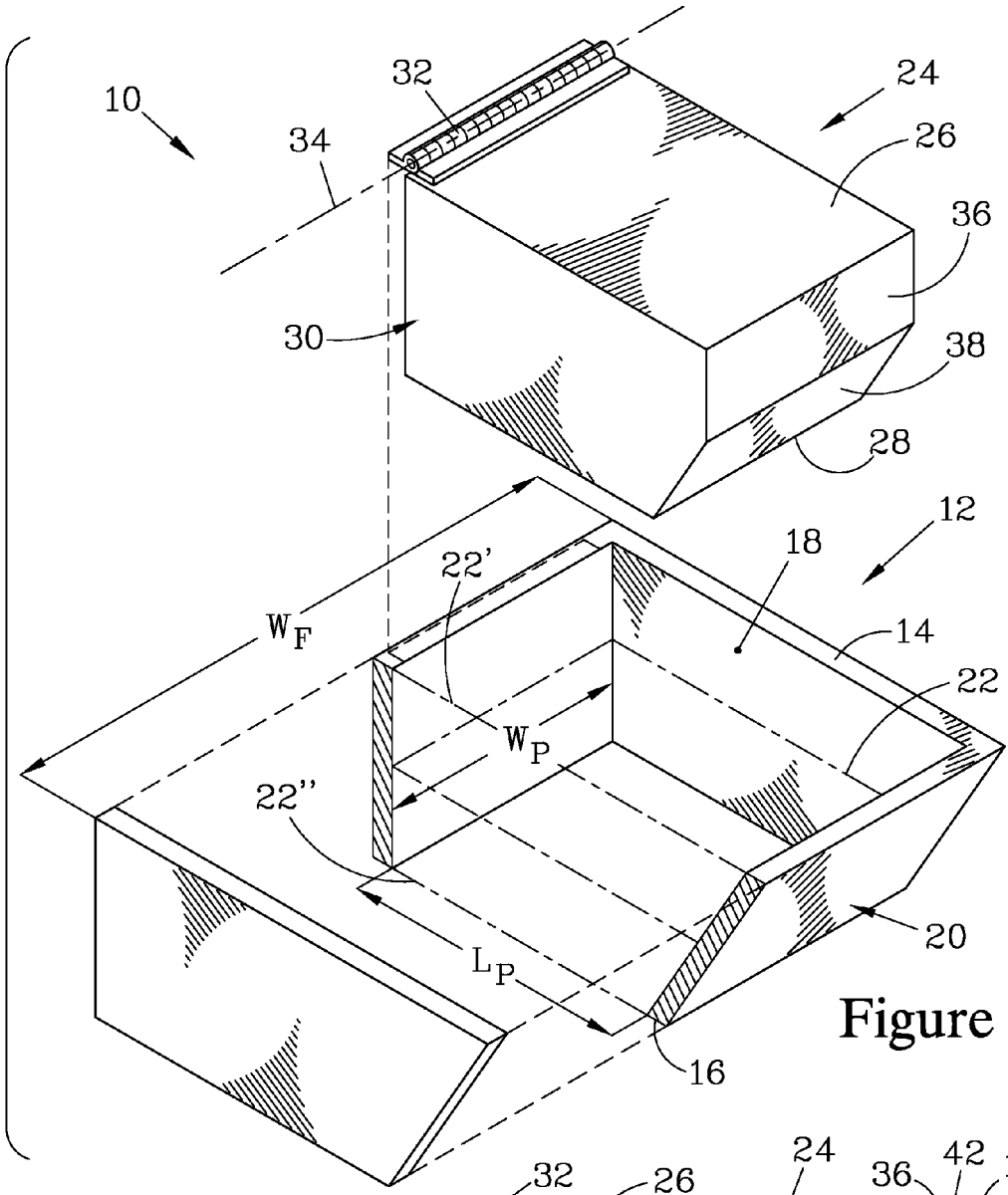
FIG. 1 is an exploded isometric view of one embodiment of the ceiling hatch of the present invention. The hatch has a frame having an upper edge and a lower edge with a passage therebetween bounded by a sidewall. The frame has horizontal sections that are rectangular and is sized to fit between rafters of an attic, having an overall frame width $W_F$ such that the frame can slide between two adjacent rafters and be attached thereto, while the passage has a minimum cross section at the lower edge that defines a passage minimum width $W_P$ of sufficient size to allow a person to readily pass through and obtain access to the space above. The frame has a length which varies from a maximum at the upper edge to a minimum at the lower edge, where the frame defines a passage minimum length $L_P$. An insulating block is attached to the frame by a hinge which is configured such that the insulating block can be rotated into and out of the passage without interference and substantially fills the passage when rotated into the passage. The insulating block has a faceted side surface where one of the facets is configured to engage the sidewall to maintain a bottom surface of the insulating block horizontal.

FIG. 1 is a partially sectioned and exploded isometric view of a ceiling hatch 10 that forms one embodiment of the present invention. The ceiling hatch 10 has a frame 12 which terminates in an upper edge 14 and a lower edge 16, and has a passage 18 that extends between the upper edge 14 and the lower edge 16. The passage 18 is bounded by a sidewall 20. The passage 18 is further configured such that it has a cross section 22 which decreases as the passage 18 traverses from the upper edge 14, where the cross section 22' is greatest, to the lower edge 16, where the cross section 22" has reached its minimum cross section and defines a passage minimum width $W_P$ and a passage minimum length $L_P$.

For installation in a ceiling having rafters spaced on 24 inch (61 cm) centers, which is typical for residential construction, the frame 12 preferably has a frame width $W_F$ less than 22½ inches (57 cm) so that the frame 12 can slide between two adjacent rafters and be attached thereto. However, the passage minimum width $W_P$ must be maintained sufficiently large as to allow a person to readily pass through and obtain access to the space thereabove. For structures with rafters on 24 inch (61 cm) centers, the frame 12 can readily be constructed from 1 inch nominal thickness lumber with a frame width $W_F$ of 22 inches (56 cm), which results in a passage minimum width $W_P$ of 20½ inches (52 cm). Preferably, the passage minimum length $L_P$ is at least about 30 inches (76 cm). It might be noted that the International Building Code requires a passage having minimum dimensions of 22"×30" (56 cm×76 cm). While the dimensions set forth above do not meet this code, the hatch 10 having such dimensions can be used in areas which do not have such a restrictive code. When the passage minimum width $W_P$ is to be increased, which may be necessary in some locations to meet the local building code, such could be accomplished by using thinner material for the sidewall 20 or by installing the hatch 10 between two alternate rafters, with a portion of the intermediate rafter removed. Alternatively, splices could be attached to the outer sides of two adjacent rafters and the rafters subsequently cut away to provide space into which to install the hatch 10.

Figure 2:
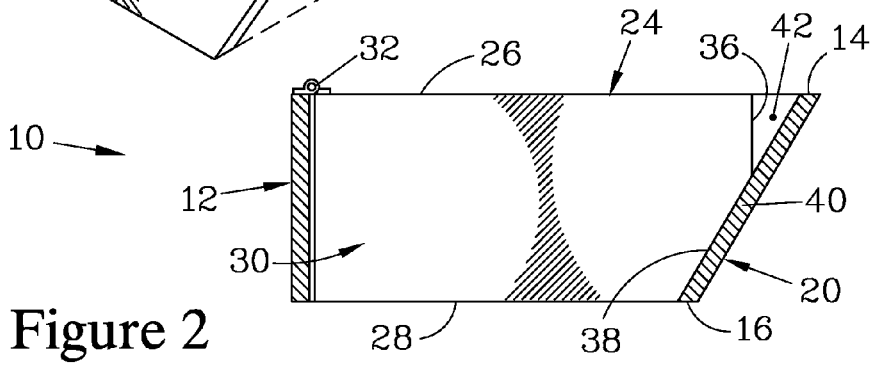
FIG. 2 is a cross section view of the assembled hatch of FIG. 1, showing the engagement of one of the facets of the side surface of the insulating block with a portion of the sidewall of the frame.

An insulating block 24 is provided, and is fabricated from a material with a high R factor such as expanded polystyrene, and can be a blown polystyrene foam. The insulating block 24 is bounded by a top surface 26, a bottom surface 28, and a faceted side surface 30. The insulating block 24 is configured to reside within and substantially fill the passage 18. When the insulating block 24 is positioned in the passage 18 with the bottom surface 28 flush with the lower edge 16, as shown in FIG. 2, a substantial portion of the side surface 30 is in contact with or in close proximity to the sidewall 20 so as to impede air flow between the insulating block 24 and the frame 12.

In the present embodiment, a continuous hinge 32 such as a piano hinge is attached to the upper edge 14 of the frame 12 and to the top surface 26 of the insulating block 24 to pivotally connect the insulating block 24 to the frame 12. The hinge 32 allows the insulating block 24 to be pivoted relative to the frame 12 about a pivot axis 34 that is spaced apart from the lower edge 16 of the frame 12. The side surface 30 is configured relative to the sidewall 20 so as to allow the insulating block 24 to be pivoted out of the passage 18 to open the hatch 10, or into the passage 18 to close the hatch 10. It should be noted that employing a continuous hinge brings an additional benefit, in that a greater separation can be allowed between the portions of the sidewall 20 and the side surface 30 lying therebelow without creating an air passage which could substantially reduce the insulating capacity of the hatch 10.

The insulating block 24 is further configured such that, when it is rotated into the passage 18, at least one facet of the side surface 30 engages the sidewall 20 of the frame 12 in such a manner as to block further pivoting of the insulating block 24. Thus, this engagement provides means for maintaining the bottom surface 28 of the insulating block 24 in a horizontal plane when the ceiling hatch 10 is closed. In this embodiment, the side surface 30 has an end facet 36 that forms a vertical surface when the ceiling hatch 10 is closed, and a contacting facet 38, which is inclined and angled with respect to the end facet 36 such that the contacting facet 38 engages a sloped segment 40 of the sidewall 20 when the ceiling hatch 10 is closed, as shown in the section view of FIG. 2.

Having the vertical end facet 36 foreshortens the top surface 26 with respect to the passage 18 in the vicinity of the upper edge 14 of the frame 12, and provides an open region 42 which allows the end facet 36 to be gripped by a user when the hatch 10 is closed, so that the hatch 10 can be readily opened.

When the hatch 10 is installed into a cut-out in a ceiling, the cut-out must be contoured to match the contour of the lower edge 16. The frame 12 is lowered into the cut-out and affixed to the rafters. Great care must be taken to avoid leaving unsightly gaps which must be filled or covered.

Figure 3:
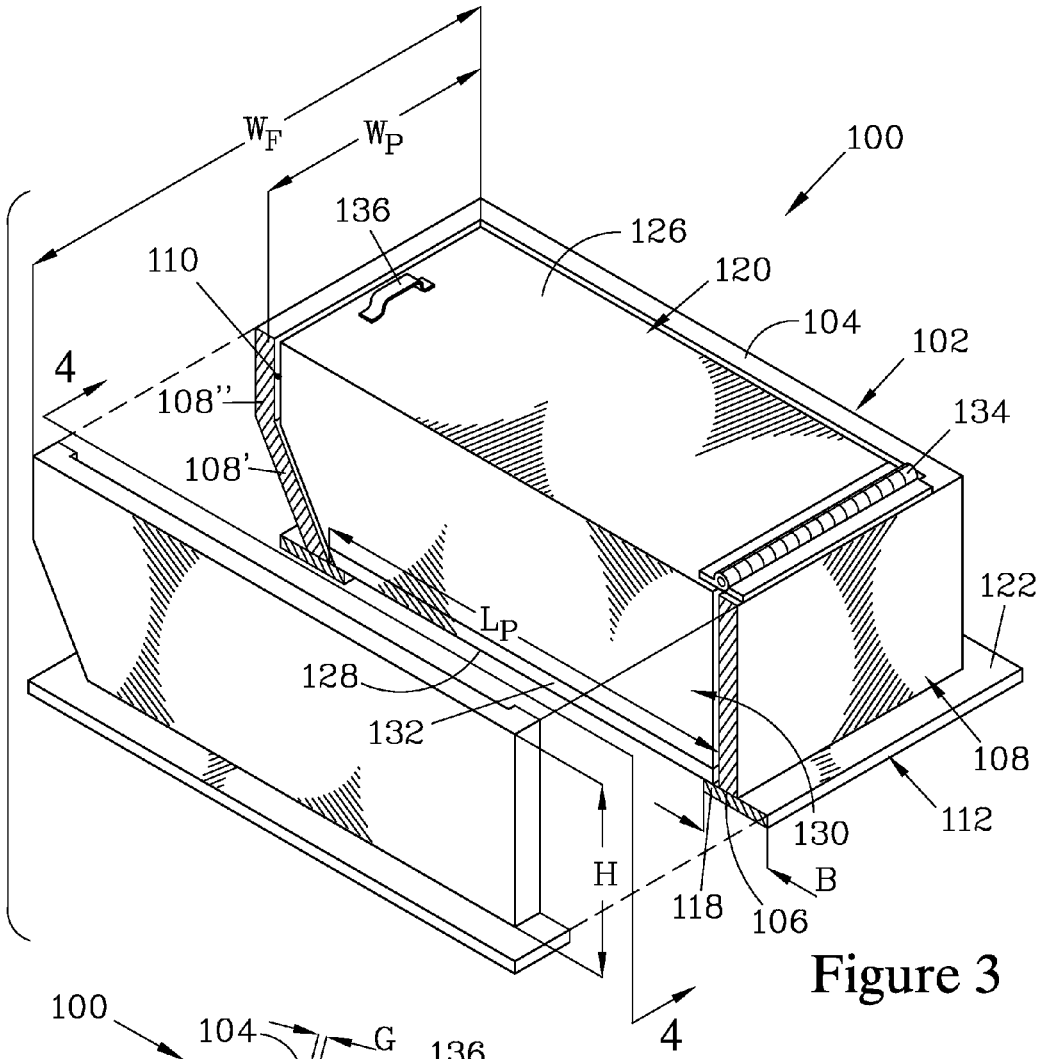
FIG. 3 is a partially exploded view of another embodiment of the ceiling hatch of the present invention which shares many of the attributes of the embodiment illustrated in FIGS. 1 and 2. This embodiment has a frame which again has horizontal sections that are rectangular and which has a frame width $W_F$ that is sized to fit between adjacent rafters. However, in this embodiment the passage minimum length $L_P$ of the passage has been increased so that it is significantly greater than the passage minimum width $W_P$. The frame of this embodiment also includes a rim mounted to the lower edge of the frame. The rim has a breadth B sufficient that, when mounted on the lower edge of the frame, the rim extends under the periphery of the passage forming a passage lip that supports the insulating block when the hatch is closed. The rim also extends beyond the periphery of the frame to form a flange thereabout. This embodiment has particular utility in that it can be retrofitted into an existing ceiling. The breadth B of the rim is selected so as to make the flange sufficiently large to cover a cut-out that is cut into the ceiling, where the cut-out is oversized to allow passage therethrough of the frame when the frame has a frame height H. This embodiment also has the upper region of all walls of the frame vertical. The insulating block of this embodiment has a layer of a fire-resistant material which forms a bottom surface of the insulating block. This embodiment also has a handle attached to the insulating block to allow a user to raise the block in the event that the hatch should close while the user is in the attic.
Figure 4:
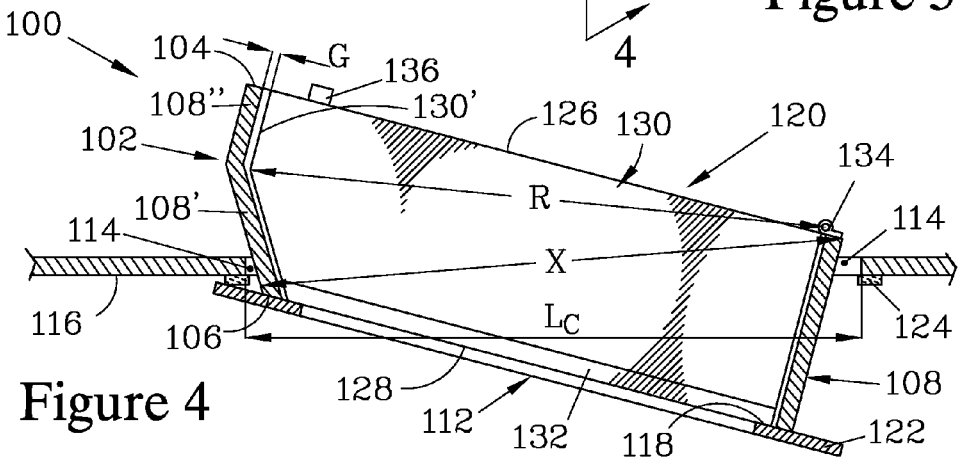
FIG. 4 is a view of section 4-4 of FIG. 3, illustrating the hatch being installed in a ceiling. The view illustrates the critical dimension X for rotating the hatch into an oversized cut-out in a ceiling as well as a gap G required between one segment of the sidewall and the opposed facet of the side surface of the insulating block to allow the insulating block to be pivoted out of the passage without interference. As illustrated, the installation employs a gasket to seal the rim with respect to the ceiling.

FIGS. 3 and 4 illustrate another embodiment of the present invention, a ceiling hatch 100 that has many of the features of the ceiling hatch 10 illustrated in FIGS. 1 and 2. The ceiling hatch 100 again has a frame 102 which terminates in an upper edge 104 and a lower edge 106, and which has a sidewall 108 that bounds a passage 110. Again, the passage 110 has a cross section which decreases as the passage 110 progresses toward the lower edge 106. The sidewall 108 differs in part from the sidewall 20 of the embodiment of FIGS. 1 and 2 in that, while there is a sloped sidewall segment 108', this surface terminates prior to the upper edge 104 of the frame and the sloped sidewall segment 108' is continued by a vertical sidewall segment 108" attached thereto and extending to the upper edge 104. This configuration provides a more convenient shape about which insulation can be packed. It also provides a cost saving when the frame 102 is constructed from lumber in that it reduces the maximum width of the boards needed, reducing the cost of fabrication. The frame 102 also differs in that the minimum cross section of the passage has a passage minimum length $L_P$ which is substantially larger than a passage minimum width $W_P$. This geometry offers increased accessability to the space above while still maintaining a frame width $W_F$ that allows the hatch 100 to be installed without interfering with the rafter layout above the ceiling.

The frame 102 of this embodiment has a rim 112 which is attached to the lower edge 106 of the frame 102. The rim 112 provides a dual function when configured as illustrated. When provided with a breadth B and positioned as shown with respect to the sidewall 108, the rim 112 can mask gaps 114 (shown in FIG. 4) between a ceiling 116 and the frame 102. The rim 112 also provides a lip 118 which resides under the passage 110. When the hatch 100 is closed, the lip 118 supports, at least in part, an insulating block 120. In this embodiment, the rim 112 is attached to the frame 102 and becomes part thereof. For the rim 112 to be effective in masking the gaps 114, the breadth B of the rim 112 must be large enough to create an extending flange 122 of sufficient width to conceal the gaps 114. The size of the gaps 114 is determined by a cut-out length $L_C$ that in turn is determined by a quasi-diagonal length X of the frame 102 which allows the upper edge 104 to be rotated behind the ceiling 116. As illustrated, a gasket 124 is employed to provide a better seal between the ceiling 116 and the ceiling hatch 100.

To reduce heat loss through the ceiling it is preferred to provide a thick layer of insulating material above the ceiling, and preferably an average thickness of insulation of about 10-12 inches (25-30 cm) is added above a ceiling. Thus, for general acceptance, it is desirable for the frame 102 to have a height H sufficient to allow the sidewall 108 to accommodate an insulation bed above the ceiling with an average depth of 12 inches (30 cm). This range of depth can be attained by providing the frame 102 with a height H of about 11 inches (28 cm), which also allows the frame 102 to be readily constructed from 12 inch nominal width lumber. When tipping the frame 102 into the ceiling 116, there is a necessary minimum for the cut-out length $L_C$ which is required to pass the upper edge 104 of the frame 102 through the cut-out in the ceiling 116. The flange 122 should extend sufficiently far to allow the gaps 114 to be covered by the flange 122, and the flange 122 should extend at least about ½ inch (13 mm) beyond the gaps 114.

The insulating block 120 is again fabricated from a high R value material such as polystyrene foam. The block 120 is bounded by a top surface 126, a bottom surface 128, and a side surface 130. In this embodiment, the insulating block 120 is provided with a terminal layer 132 which is fabricated of a fire retarding material such as wall board or ceiling tile, on which the bottom surface 128 is provided. When such materials are used, the terminal layer 132 not only provides fire retardance, but also allows the bottom surface 128 to substantially match the surrounding ceiling.

Again, a continuous hinge 134 is employed to pivotally attach the insulating block 120 to the frame 102 so that the insulating block 120 can be pivoted into the passage 110. The side surface 130 generally follows the contour of the passage 110 and preferably resides in close proximity to the sidewall 108; however, a portion 130' of the side surface 130 must be sufficiently spaced apart from the sidewall 108 as to provide a gap G sufficiently wide to allow the radius R to be rotated out of the passage 110. A handle 136 is provided on the top surface 126 to assist in opening the ceiling hatch 100 if the hatch 100 is closed when the user is in the space above the ceiling 116.

As noted above, the lip 118 formed by the rim 112 can serve to support the insulating block 120. The bottom surface 128 can rest on the lip 118 when the block 120 resides within the passage 110, the lip 118 thereby providing means for maintaining the bottom surface 128 in a horizontal plane. The engagement of the bottom surface 128 with the lip 118 can also serve to enhance sealing between the insulating block 120 and the frame 102.

Figure 5:
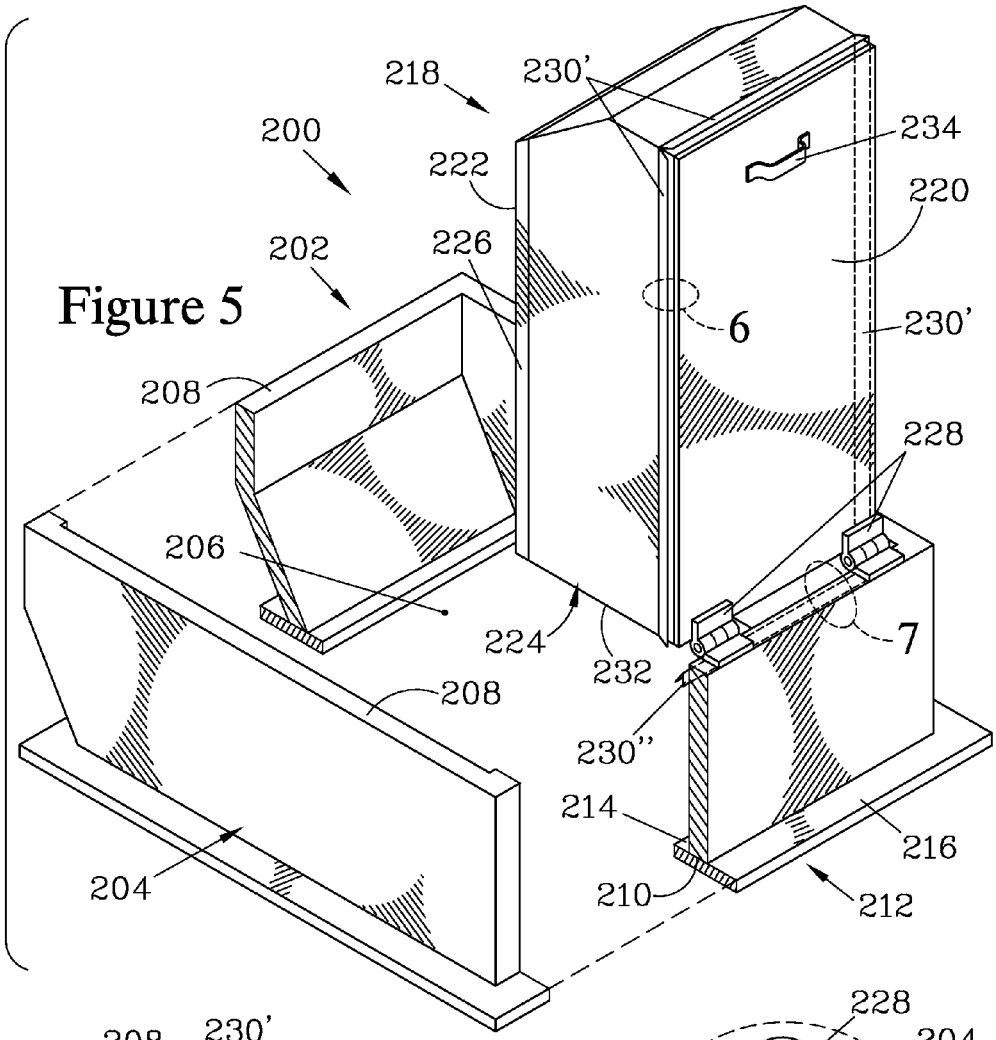
FIG. 5 is a partially exploded isometric view of a ceiling hatch that forms another embodiment of the present invention. This embodiment has weatherstripping that is interposed between the insulating block and the sidewall of the frame so as to provide a seal between the upper edge of the frame and the top surface of the insulating block.

FIG. 5 illustrates another embodiment of a ceiling hatch 200, which has the same general structure and geometric configuration as the ceiling hatch 100 illustrated in FIGS. 3 and 4. The ceiling hatch 200 has a frame 202 which in turn has a frame sidewall 204 that surrounds a passage 206 and terminates in an upper edge 208 and a lower edge 210. A rim 212 is attached to the lower edge 210, the rim 212 being sized and positioned so as to create both a lip 214, which extends from the lower edge 210 of the frame 202 and below the passage 206, and a flange 216, which extends from the lower edge 210 and serves to provide closure between the lower edge 210 and a cut-out in a ceiling (not shown) into which the frame 202 is installed.

An insulating block 218 is also provided, which has a top surface 220, a bottom surface 222 and a side surface 224. The side surface 224 is configured such that the insulating block 218 can be positioned in the passage 206. While the insulating block 218 is formed of a high R foam polymer, it is preferred that the bottom surface 222 be treated so as to provide a flame retardant surface. In this embodiment, the flame retardant surface is provided by a lower laminar 226 of a flame retardant material. One such material is wall board, such as is commonly used for ceilings. The use of wall board as the lower laminar 226 has an additional benefit in that it reduces the visual contrast between the bottom surface 222 and the surrounding ceiling when the hatch 200 is closed.

In this embodiment, a pair of hinges 228 are employed to connect the insulating block 218 to the frame 202 so that the insulating block 218 can be pivoted into and out of the frame 202 to close and open the hatch 200. A seal between the insulating block 218 and the frame 202 can be provided, in part, by contact between the lip 214 and the lower laminar 226. However, in this embodiment, weatherstripping 230 is provided to form a seal between the block 218 and the frame 202. There are many positions where the weatherstripping 230 can be applied to block the passage of air through the ceiling hatch 200. For the hatch 200, the weatherstripping 230 is positioned between the sidewall 204 and the sides surface 224. In this embodiment, the weatherstripping 230 is a strip of folded resilient material having a V-shaped cross section, as better illustrated in FIGS. 6 and 7. Three segments 230' of the weatherstripping 230 are affixed to the non-hinged sides of the insulating block 218, where they are not subject to damage by persons passing through the hatch 200. These segments 230' are attached to the upper portion of the side surface 224 of the insulating block 218 and positioned such that they become wedged between the insulating block 218 and the frame 202 as the insulating block 218 swings to the closed position, as is illustrated in FIG. 6.

Figure 7:
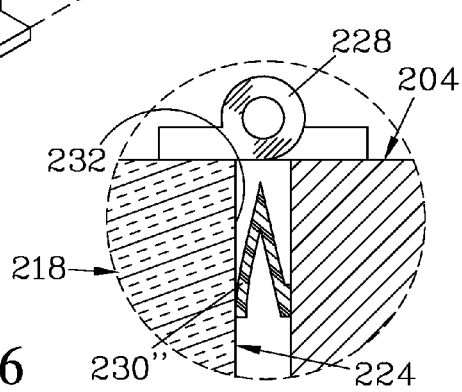
FIG. 7 is a detail section view of the region 7 of FIG. 5, illustrating the position of another of the weatherstripping segments.

The fourth segment 230" of the weatherstripping 230 is positioned to engage the upper portion of a facet 232 of the side surface 224 beneath the hinges 228, as shown in FIG. 7. This fourth segment 230" is preferably attached to the sidewall 204 of the frame 202 rather than to the insulating block 218. This segment 230" is mounted with the V-shape inverted compared to the segments 230', which allows the weatherstripping to be readily compressed by the insulating block 218 as the hatch 200 is closed.

The spring action of the folded resilient weatherstripping 230 maintains forcible engagement between the side surface 224 of the insulating block 218 and the sidewall 204 of the frame 202 to block air infiltration. Since the spring action creates resistance to opening, a handle 234 is attached to the top surface 220 of the insulating block 218 to facilitate opening from above.

Figure 6:
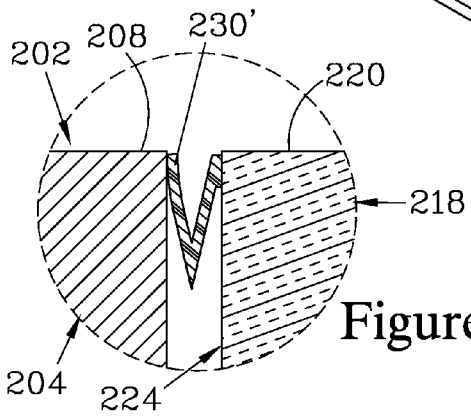
FIG. 6 is a section view of the region 6 of FIG. 5, illustrating the position of one of the weatherstripping segments when the insulating block is positioned in the passage.
Figure 8:
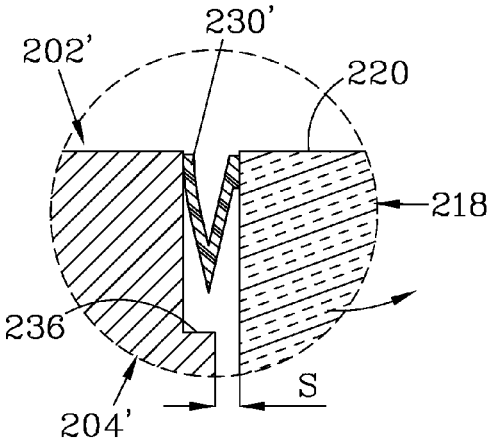
FIG. 8 is a view that corresponds to the view of FIG. 6, illustrating another embodiment which has a setback in the portion of the sidewall that is engaged by the weatherstripping so as to reduce the resistance of the weatherstripping to closure of the hatch, while maintaining the sidewall in close proximity to the insulating block.

FIG. 8 is a view which corresponds to the view of FIG. 6, showing an alternative embodiment where the sidewall 204' of the frame 202' has a setback 236 to partially accommodate the weatherstripping segment 230'. The setback 236 allows space for the weatherstripping segment 230' to create a desired degree of forcible engagement between the side surface 224 and the sidewall 204' while maintaining a reduced separation S therebetween to further impede air infiltration.

Figure 9:
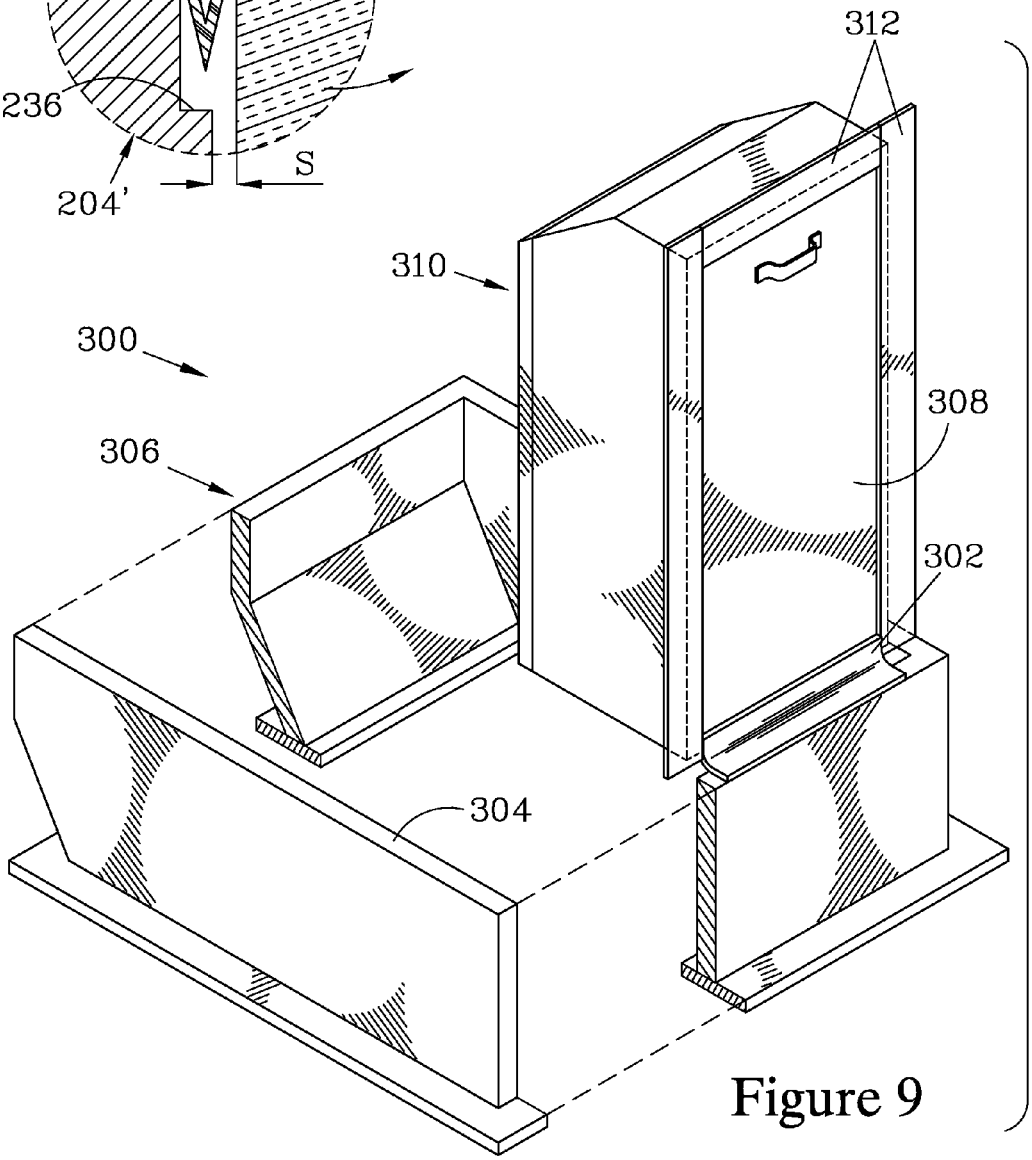
FIG. 9 is a partially exploded isometric view of a ceiling hatch which forms another embodiment of the present invention that is similar to the embodiment shown in FIG. 5. In this embodiment, a flexible sheet material is employed as a hinge that also provides a seal. This embodiment also employs weatherstripping that is attached to the top surface of the insulating block and configured to engage the upper edge of the frame to provide a seal between the insulating block and the frame.

FIG. 9 is an isometric view a ceiling hatch 300 which differs from the ceiling hatch 200 in only two respects. The first difference is that a sheet of a flexible resilient material serves a hinge 302, which is attached to an upper edge 304 of a frame 306 and to a top surface 308 of an insulating block 310. Since the hinge 302 is formed from a sheet, it also serves to provide a seal between the attached regions of the frame 306 and the insulating block 310, thereby negating the need for weatherstripping below the hinge 302. The second difference is the position and configuration of weatherstripping 312, which is attached to the top surface 308 of the insulating block 310 and is configured to rest on the upper edge 304 of the frame 306 when the ceiling hatch 300 is closed.

FIG. 10 is an isometric view of a ceiling hatch 400 which differs from the ceiling hatch 200 in only two respects. The first difference is that a continuous hinge 402 is employed to attach an upper edge 404 of a frame 406 to an adjacent top surface 408 of an insulating block 410. The hinge 402, being a continuous hinge that extends across the adjacent elements, can also serve to provide a quasi-seal between the attached regions of the frame 406 and the insulating block 410, thereby negating the need for weatherstripping below the hinge 402. The second difference is the use of a cap 412 that is attached to the top surface 408 of the insulating block 410. The cap 412 is configured to rest on the upper edge 404 of the frame 406 when the hatch 400 is closed. Weatherstripping (not shown) can be mounted to the cap 412 so as to be compressed between the cap 412 and the upper edge 404 when the hatch 400 is closed. The engagement between the cap 412 and the upper edge 404 can also serve to maintain a bottom surface 414 of the insulating block 410 horizontal when the hatch 400 is closed.

While the novel features of the present invention have been described in terms of particular embodiments and preferred applications, it should be appreciated by one skilled in the art that substitution of materials and modification of details obviously can be made without departing from the spirit of the invention.

What I claim is:

1. A ceiling hatch comprising:

a frame having an upper edge and a lower edge and a passage bounded by a sidewall passing therebetween, said passage extending from said lower edge to said upper edge and having its minimum cross section at said lower edge;

a block of insulation bounded by a top surface, a bottom surface and a side surface which is configured such that said block of insulation is positionable substantially within said passage and substantially fills the same, assuring that said side surface resides in close proximity to said sidewall of said frame, thereby impeding air flow between said side surface and sidewall;

a hinge operably attached to said frame and to said block of insulation, providing pivotable action between said block of insulation and said frame about a pivot axis, said hinge being so positioned and said side surface of said block of insulation and said passage through said frame being so configured as to allow said block of insulation to be swung out of said passage on an interference free path; and means for maintaining said bottom surface of said block of insulation in a horizontal plane when said block of insulation resides substantially within said passage.

2. The ceiling hatch of claim 1 further comprising:

a rim mounted to said lower edge of said frame and extending outwardly therefrom to provide a flange.

3. The ceiling hatch of claim 2 wherein said means for maintaining said bottom surface horizontal is provided by a lip extending inwardly from said lower edge and formed by a portion of said rim, said lip serving to support said bottom surface of said block of insulation.

4. The ceiling hatch of claim 3 wherein said passage has a rectangular cross section and is bound by a pair of parallel vertical sidewalls spaced apart and terminating at a vertical back wall and at a sloped front wall, and further wherein said side surface of said block of insulation is faceted and configured to provide a pair of parallel spaced apart side facets, a back facet, and a front facet, said facets being configured such that, when said block of insulation resides substantially within said passage said side facets are each parallel to and in close proximity to one of said pair of parallel vertical sidewalls and said back facet is substantially parallel to and in close proximity to said vertical back wall, and said front facet being configured such that at least a portion thereof is in close proximity with said sloped front wall, and still further wherein said hinge is aligned such that said pivot axis is parallel to said vertical back wall and to said back facet.

5. The ceiling hatch of claim 4 further comprising:

weatherstripping positioned so as to form a seal between said frame and said block of insulation when said block of insulation resides substantially within said passage.

6. The ceiling hatch of claim 5 wherein said weatherstripping is positioned in close proximity to said upper edge of said frame and said top surface of said block of insulation when said block of insulation resides substantially within said passage.

7. The ceiling hatch of claim 6 wherein said weatherstripping is a folded strip of a resilient material.

8. The ceiling hatch of claim 1 further comprising:

a block cap attached to said top surface of said block of insulation and extending therebeyond so as to engage said upper edge of said frame when said bottom surface of said block of insulation is substantially horizontal.

9. The ceiling hatch of claim 1 wherein said close proximity of said side surface to said sidewall is such that said side surface is separated from said sidewall by a distance of less than about ⅛inch over a substantial portion of said side surface and said sidewall.

10. The ceiling hatch of claim 1 wherein said block of insulation is fabricated from a material providing a high R value.

11. The ceiling hatch of claim 10 wherein said material providing a high R value is a polymer foam.

12. The ceiling hatch of claim 11 wherein said block of insulation further comprises:

a layer of fire retardant material attached to said polymer foam and forming said bottom surface of said block of insulation.

13. The ceiling hatch of claim 1 wherein said frame has a height H of at least about 11 inches.

14. A ceiling hatch comprising:

a frame having an upper edge and a lower edge and a passage bounded by a sidewall passing therebetween, said passage extending from said lower edge to said upper edge and having its minimum cross section at said lower edge, wherein said passage has a rectangular cross section and is bound by a pair of parallel vertical sidewalls spaced apart and terminating at a vertical back wall and at a sloped front wall;

an insulating block bounded by a top surface, a bottom surface and a side surface which is configured such that said insulating block is positionable substantially within said passage and substantially fills the same, wherein said side surface of said insulating block is faceted and configured to provide a pair of parallel spaced apart side facets, a back facet, and a front facet, said facets being configured such that, when said insulating block resides substantially within said passage said side facets are each parallel to and in close proximity to one of said pair of parallel vertical sidewalls and said back facet is substantially parallel to and in close proximity to said vertical back wall, and said front facet being configured such that at least a portion thereof can be mated with said sloped front wall;

a hinge operably attached to said frame and to said insulating block, providing pivotable action between said insulating block and said frame about a pivot axis, said hinge being so positioned and said side surface of said insulating block and said passage through said frame being so configured as to allow said insulating block to be swung out of said passage on an interference free path, wherein said hinge is aligned such that said pivot axis is parallel to said vertical back wall and to said back facet; and means for maintaining said bottom surface of said insulating block in a horizontal plane when said insulating block resides substantially within said passage.

15. The ceiling hatch of claim 14 further comprising:

weatherstripping positioned so as to form a seal between said sidewall of said frame and said side surface of insulating block when said insulating block resides substantially within said passage.

16. The ceiling hatch of claim 15 wherein said weatherstripping is positioned in close proximity to said upper edge of said frame and said top surface of said insulating block when said insulating block resides substantially within said passage.

17. The ceiling hatch of claim 16 wherein said weatherstripping is a folded strip of a resilient material.

18. The ceiling hatch of claim 14 further comprising:

a rim mounted to said lower edge of said frame, said rim residing below said passage and extending outwardly from said lower edge to provide a flange.

19. The ceiling hatch of claim 18 wherein said means for maintaining said bottom surface horizontal is provided by a lip extending inwardly from said lower edge and formed by a portion of said rim, said lip serving to support said bottom surface of said insulating block.

20. The ceiling hatch of claim 14 wherein said frame has a height H of at least about 11 inches.

* * * * *